US007527568B2

(12) United States Patent
Joseph

(10) Patent No.: US 7,527,568 B2
(45) Date of Patent: May 5, 2009

(54) SYSTEM AND METHOD FOR TRAINING A FOOTBALL PLAYER

(75) Inventor: John G. Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 97 days.

(21) Appl. No.: 11/468,467

(22) Filed: Aug. 30, 2006

(65) Prior Publication Data

US 2008/0058128 A1 Mar. 6, 2008

(51) Int. Cl.
*A63B 69/00* (2006.01)

(52) U.S. Cl. ..... 473/441; 473/422; 473/444

(58) Field of Classification Search ..... 473/441, 473/442, 422, 444; 482/8, 9, 54; 434/251
See application file for complete search history.

(56) References Cited

U.S. PATENT DOCUMENTS 3,332,683 A * 7/1967 Rand ..... 482/54
3,825,260 A * 7/1974 Thomas, Sr. ..... 473/444
3,997,160 A 12/1976 George
4,067,571 A 1/1978 Rogers
4,186,922 A 2/1980 Ketchum
4,218,060 A 8/1980 Forrest
4,447,056 A 5/1984 Dalton
4,477,076 A 10/1984 Monaco
4,534,557 A 8/1985 Bigelow et al.
4,688,795 A 8/1987 Callaway, Jr.
4,753,680 A 6/1988 Burow et al.
4,774,679 A 9/1988 Carlin
4,802,670 A 2/1989 Smith
4,883,271 A * 11/1989 French ..... 273/454
4,943,057 A 7/1990 Felder
5,013,039 A 5/1991 Cole
5,058,884 A 10/1991 Fuller, Sr.
5,271,627 A 12/1993 Russell et al.
5,280,905 A * 1/1994 Micco ..... 473/444
5,462,272 A 10/1995 Staten
5,469,740 A 11/1995 French et al.
5,474,290 A 12/1995 Rascona et al.
5,574,699 A 11/1996 Cuomo
5,605,336 A 2/1997 Gaoiran et al.
5,637,063 A 6/1997 Fuller, Sr.
5,755,576 A 5/1998 Dunn et al.
5,897,457 A 4/1999 Mackovjak
5,901,961 A 5/1999 Holland, III (Continued)

OTHER PUBLICATIONS

"Snap React®" Training Aid, <http://www.snapreact.com/>, Feb. 28, 2004, Eastern Automation Systems, Farmingdale, NJ, USA.

(Continued)

*Primary Examiner*—Mitra Aryanpour
(74) *Attorney, Agent, or Firm*—Jacox, Meckstroth & Jenkins

(57) ABSTRACT

A football training system and method for training a player football technique, strength and endurance. The system provides an engagement member that can be engaged and driven upward and substantially simultaneously rearward. The system includes a life-size simulator, dummy or engagement member for providing a true-to-life training experience. The system is capable of providing increased resistance to the player as the player drives the dummy and also provides a speed and power indication to the player, his or her coach or trainer.

53 Claims, 9 Drawing Sheets

U.S. PATENT DOCUMENTS

| | | | | |
|---|---|---|---|---|
| 5,980,398 | A | 11/1999 | Shingleton | |
| 6,002,336 | A | 12/1999 | Widding et al. | |
| 6,036,609 | A | 3/2000 | Gilman | |
| 6,045,464 | A | 4/2000 | Crist, Jr. | |
| 6,058,517 | A | 5/2000 | Hartunian | |
| 6,093,119 | A * | 7/2000 | Tipton | 473/438 |
| 6,110,079 | A | 8/2000 | Luedke et al. | |
| 6,261,195 | B1 | 7/2001 | Shingleton | |
| 6,308,565 | B1 | 10/2001 | French et al. | |
| 6,309,327 | B1 | 10/2001 | Hallberg | |
| 6,375,584 | B1 | 4/2002 | Shapiro | |
| 6,430,997 | B1 | 8/2002 | French et al. | |
| 6,458,051 | B1 | 10/2002 | Moore | |
| 6,575,879 | B1 | 6/2003 | Harney et al. | |
| 6,599,206 | B1 * | 7/2003 | Forrest et al. | 473/441 |
| 6,685,581 | B2 * | 2/2004 | Krause et al. | 473/445 |
| 6,710,713 | B1 | 3/2004 | Russo | |
| 6,749,432 | B2 | 6/2004 | French et al. | |
| 6,761,650 | B1 | 7/2004 | Dettmann | |
| 6,765,726 | B2 | 7/2004 | French et al. | |
| 6,876,496 | B2 | 4/2005 | French et al. | |
| 6,929,479 | B2 | 8/2005 | Bellows et al. | |
| 6,942,585 | B1 | 9/2005 | Krause | |
| 6,988,965 | B2 | 1/2006 | Krause | |
| 7,029,426 | B1 | 4/2006 | Fuller, Sr. | |
| 7,038,855 | B2 | 5/2006 | French et al. | |
| 7,070,521 | B2 * | 7/2006 | Bayduke | 473/438 |
| 7,131,917 | B2 * | 11/2006 | Spencer | 473/444 |
| 7,322,893 | B2 * | 1/2008 | Bright | 473/441 |

OTHER PUBLICATIONS

Super Leg Drive, Mar. 2, 2001, Four Austin's Inc., Lubbock, Texas, USA.

Herman, Digital Interactive Training Partner, Nov. 24, 2005, Century, Inc., Midwest City, Oklahoma, USA.

Rogers TredsledTM, Jul. 30, 2003, Rogers Athletic Company, Farwell, Michigan, USA.

D-Cleater Training Device, Dec. 5, 2002, D-Cleater, Inc., Distributed by Grand Hall USA, Garland, Texas USA.

Austin Leg Drive Machine, Feb. 26, 2007, Austin Sporting Goods, Four Austin's, Inc., sold through Diamond Fitness Systems, Murrieta, California, USA.

Rogers LevSled, Feb. 26, 2007, Rogers Athletic Company, Farwell, Michigan, USA.

* cited by examiner

SYSTEM AND METHOD FOR TRAINING A FOOTBALL PLAYER

BACKGROUND OF THE INVENTION

1. Field of The Invention

This invention relates to sports training equipment and, more particularly, to a system and method for training football players and for increasing a football player's strength, while also improving the player's technique.

2. Description of Prior Art

Successful players of American-style football may possess at least two important characteristics, namely physical strength and endurance, and highly developed functional skills and techniques for applying such strength and endurance to particular game situations and positions. For example, for a lineman, such as an offensive lineman, strength and endurance is required to block opposing players of similar or even larger sizes and strength repeatedly play after play. Good functional technique is required to ensure the lineman's strength is applied properly so that the player does not slip or the opposing player does not evade the block or such that the block does not result in a penalty such as for holding. Thus, in training football players, such as linemen, it is important to develop strength endurance as well as functional playing technique.

Various types of football training equipment have been developed and used to allow players to practice their techniques without facing off against another live player, and, in some cases, even without the need for the presence of a coach or trainer. A common example of such training equipment is the conventional football training sled for teaching fundamental and functional techniques such as tackling and blocking. A typical football sled includes a horizontal base, including one or more sled-like runners, and a padded vertical extension mounted at one end of the sled base. The padded portion of the sled may be sized and shaped to represent an opposing player. A lineman may practice blocking techniques, for example, by blocking against the padded portion of the sled, driving the sled straight backwards as he would an opposing player. Weight may be added to the sled to increase effort required to drive the imitated opposing player back off the line. Some more advanced training sleds include a mechanism which allows a player both to drive the sled backward and to lift the padded portion of the sled without lifting the entire sled. This simulates player hip rotation which converts the horizontal movement generated forwardly by the player into a force which a vertical component which tends to lift the opposing player so as to render him momentarily helpless. In at least one such training sled, the padded portion of the sled is mounted on a telescoping arm. A mechanism is provided which prevents rotation of the blockage pad upward unless the pad mounted on the telescoping arm has been driven rearward by sufficient amount. Spring resistant provides resistance to rearward movement of the arm. An illustration of such a training device is shown in U.S. Pat. No. 5,462,272.

Typical football training equipment, such as training sleds are used as tools for training and practicing functional technique such as blocking, but do relatively little to increase the strength and endurance in the particularly functional application being taught or practiced. Furthermore, such training equipment is a tool for qualitative training only. With the use of such equipment, a coach or trainer can observe a player's technique and instruct him or her in required corrections and adjustments thereto. Such equipment does not provide for a quantitative measure of the effective application of the player's strength and endurance to the particular functional technique being taught in practice.

Moreover, while the apparatuses and devices of the past may provide examples of sleds having pads that can be driven, the prior art lacks a training device that simulates a game environment wherein a player is required to drive an opposing player rearward and also upward. Obviously, because not all players are built of the exact same height and shape, devices of the past did not provide a life-size dummy for performing such training and also failed to provide any type of life-size simulation that would simulate the movements of an opposing human player.

Further, the devices of the past failed to provide an indication of the power rating which provides an indication of the speed and power at which a player, such as a lineman, is engaging a life-size dummy and simultaneously driving the dummy in a desired direction. What is also lacking in the known devices of the past is that providing one or more of the combination of training devices with a capability of providing increased resistance as the player is driving the dummy upward and/or rearward, which facilitates increasing player's strength and endurance.

What is needed, therefore, is an improved training apparatus which overcomes one or more of the problems or deficiencies of the prior art.

SUMMARY OF THE INVENTION

In one embodiment, the invention provides a system and method that overcomes one or more of the problems identified in the prior art.

In another embodiment, the system and method provides a device and system for training a player proper football technique.

Still another embodiment illustrates a device that provides a life-size dummy that simulates an opposing player.

Another aspect, an embodiment is provided that provides increased resistance to the player as the player drives the training device.

In still another aspect, an engagement member is provided that can be driven upward on a predetermined angle, such as an angle of about 45 degrees, and substantially simultaneously or thereafter be driven rearward.

In still another aspect, one embodiment provides a system and method for providing an audio and visual indication of a speed and/or power rating associated with a training event during which a player engages the engaging member.

In still another aspect, another embodiment provides a system and method that enables a position of the engagement member to be adjusted relative to the player and/or relative to the ground.

In one aspect, the embodiment comprises a training system comprising a first frame, a second frame moveably mounted on the first frame so that the second frame can move in a first predetermined direction on the first frame and an engaging member moveably mounted on the second frame so that the engaging member can move on the second frame in a second predetermined direction and independently of movement of the second frame on the first frame. The second frame adapted to move from a second frame home position in a first predetermined direction when a player engages the engaging member and the engaging member adapted to move from an engaging member home position in a second predetermined direction in response to the player engaging the engaging member, wherein the engaging member and the second frame are adapted to move independently and the first predetermined direction is different from said second predetermined direction, the second predetermined direction being at least partially upward relative to the ground.

In one aspect, the embodiment comprises a training system comprising a first frame, a second frame moveably mounted on the first frame, and an engaging member moveably mounted on the second frame, the second frame adapted to move from a second frame home position in a first predetermined direction when a player engages the engaging member and the engaging member adapted to move from an engaging member home position in a second predetermined direction in response to the player engaging the engaging member, wherein the first predetermined direction is different from the second predetermined direction, wherein the system further comprises a resistance system for providing resistance as the player moves the engaging member away from the engaging member home position, wherein the second frame comprises a weight support for supporting weight, the resistance system further comprising a drive chain coupling the first frame, the second frame and the weight support such that when the player moves the engaging member away from the engaging member home position, the weight moves on a second member to provide an increased amount of resistance to the player.

In another aspect, another embodiment comprises a football training system comprising a base, a first support moveably mounted on the base, a second support moveably mounted on the first support so that the second support can move in a first direction on the first support and an engaging member support for supporting an engaging member above the ground, the engaging member support being adapted to move on the second support in a second direction independently of the movement of the second support on the first support, the engaging member being adapted to move away from the ground along a path that cooperates with the ground to define a predetermined angle and the second support also being adapted to move on the first support, the movement of the engaging member being at least partially upward relative to the ground.

In another aspect, another embodiment comprises a football training system comprising a base, a first support moveably mounted on the base, a second support moveably mounted on the first support, and an engaging member support for supporting an engaging member above the ground, the engaging member being adapted to move away from the ground along a path that cooperates with the ground to define a predetermined angle and the second support also being adapted to move on the first support, wherein the football training system further comprises a resistance system coupled to at least one of the first support, the second support or the engaging member support for providing resistance as a player moves the engaging member away from an engaging member home position, wherein the resistance increases at an increasing rate as the player moves the engaging member away from the engaging member home position, wherein the second support comprises a weight support for supporting weight, the resistance system further comprising a drive chain coupling a first frame, a second frame and the weight support such that when the player moves the engaging member away from an engaging member home position the weight support moves to provide a generally increasing amount of resistance to the player.

In another aspect, another embodiment comprises a training system comprising a first frame, a second frame moveably mounted on the first frame, and an engaging member moveably mounted on the second frame, the second frame being adapted to move from a second frame home position in a first predetermined direction when a player engages the engaging member and the engaging member adapted to move from an engaging member home position in a second predetermined direction in response to the player engaging the engaging member, wherein the first predetermined direction is different from the second predetermined direction, wherein the training system comprises resistance means for providing at least one of a variable or fixed resistance to the player after the player engages the engaging member and moves it in at least one of the first or second predetermined positions.

These and other objects and advantages of the invention will be apparent from the following description, the accompanying drawings and the appended claims.

BRIEF DESCRIPTION OF ACCOMPANYING DRAWING

DETAILED DESCRIPTION OF PREFERRED EMBODIMENT

Figure 1:
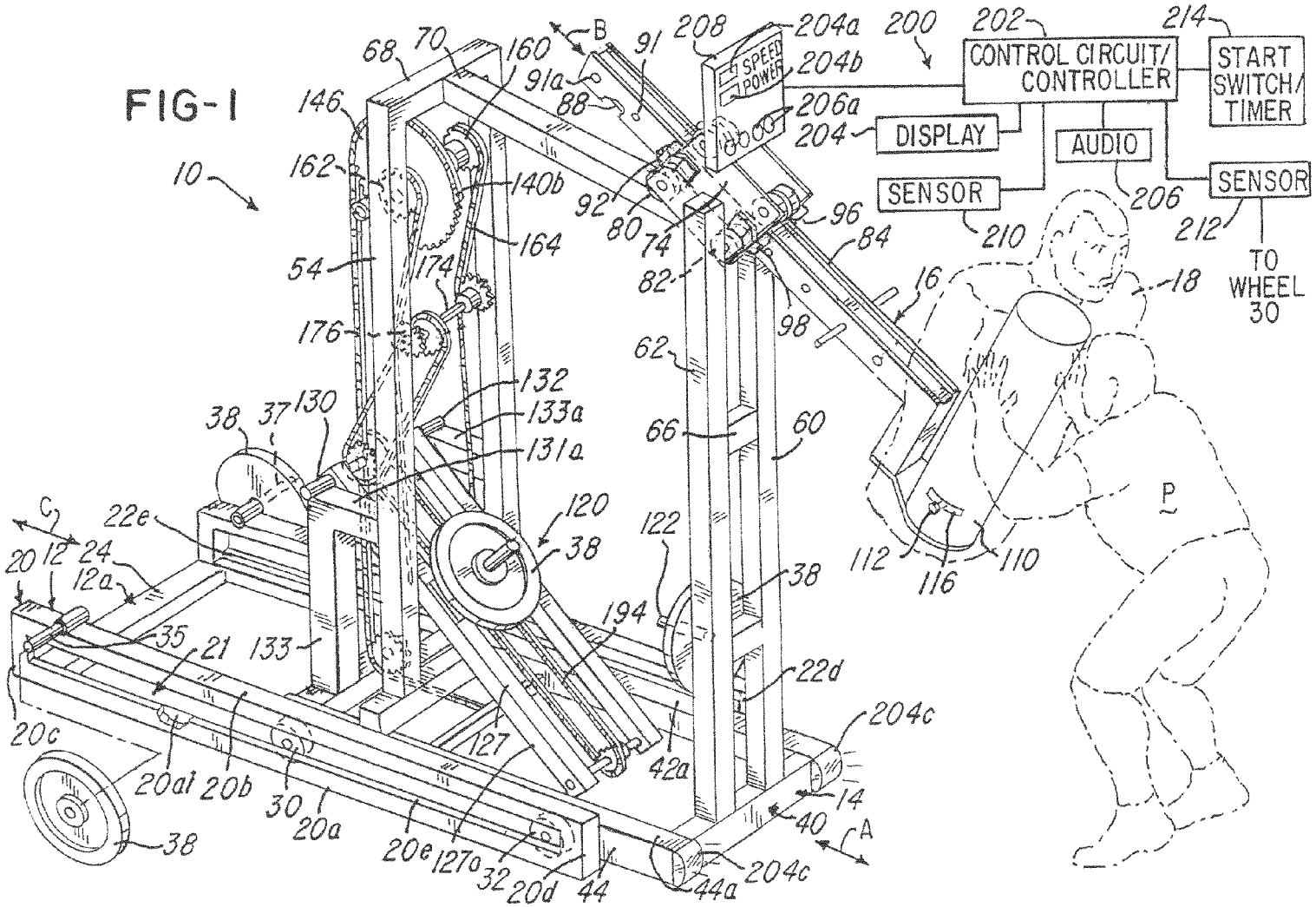
FIG. 1 is a perspective view of one embodiment of the invention illustrating a player engaging an engagement member or dummy.

Referring now to FIG. 1, a training system 10 is shown in accordance with one embodiment of the invention.

Figure 2:
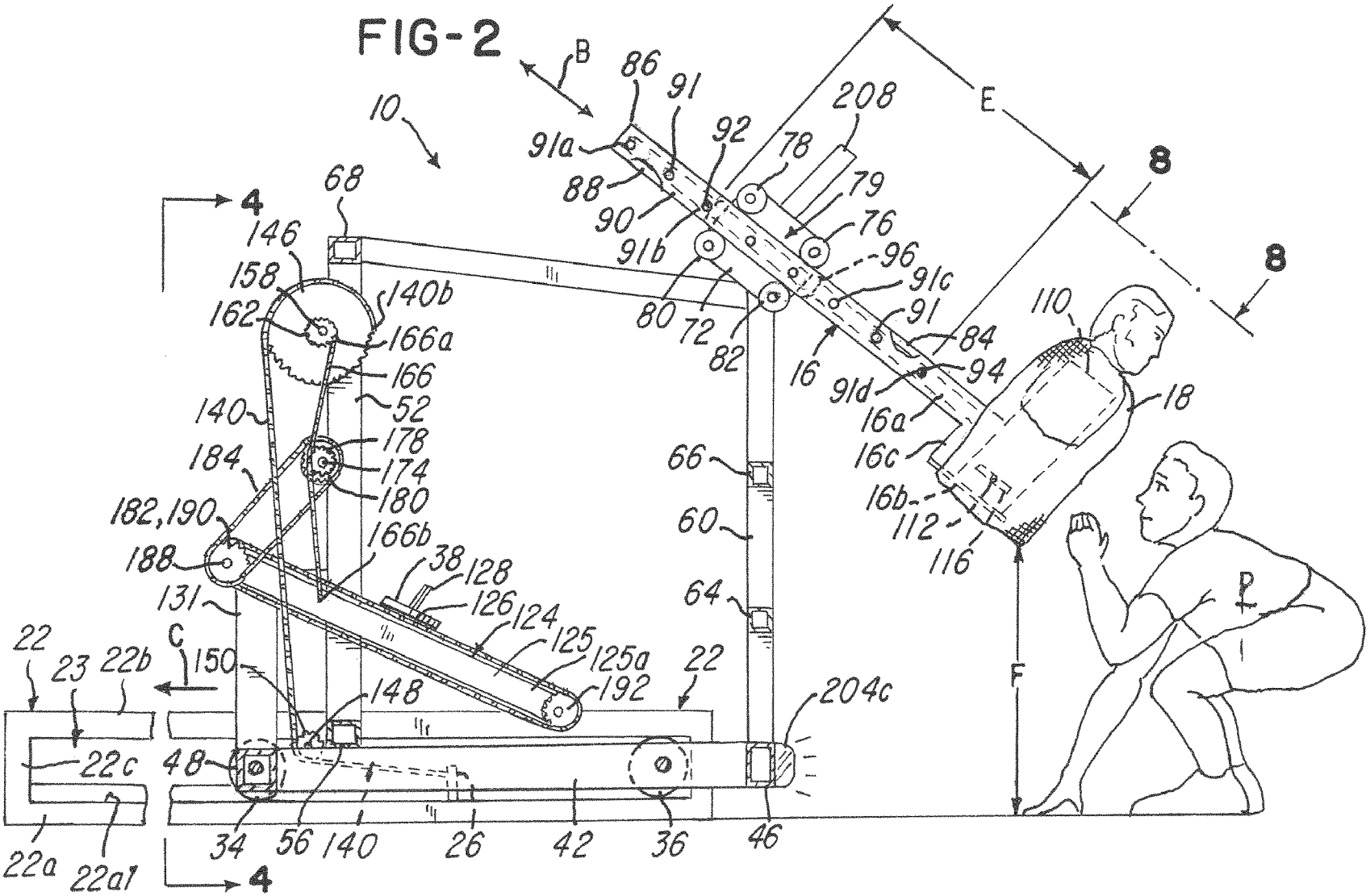
FIG. 2 is a view illustrating various features of the embodiment shown in FIG. 1 illustrating a player in a stance prior to engagement of the engagement member.

The training system 10 comprises a first frame or support 12, a second frame or support 14 that is movably mounted on the first frame 12 in a manner described later herein, and an engaging member support or frame 16 that is movably mounted on the second frame 14. In the embodiment being illustrated, the engaging member support 16 supports a generally or substantially life-like or life-size dummy or engagement member 18, which is pivotally and movably mounted on the engaging member support 16 in the manner described later herein relative to FIGS. 5-13. It should be understood that the engagement member 18 and the engaging member support 16 are both adapted to move from an engaging member home position and a second frame home position, respectively, both of which are illustrated in FIG. 2, in response to a player P engaging the engagement member 18 and moving or driving it in the manner described herein. It should be understood that the second frame 14 and the engagement member 18 may move independently or even simultaneously in directions that are not parallel or that are different.

As illustrated in FIG. 1, the first frame 12 comprises generally opposed first and second frame members 20 and 22, as illustrated in FIG. 1. The generally opposed first and second frame members 20 and 22 are each comprised of a plurality of frame members, such as frame members 20*a*, 20*b*, 20*c* and 20*d* for frame member 20 and frame members 22*a*, 22*b*, 22*c* and 22*d* for frame member 22. The frame members 20*a*-20*d* and 22*a*-22*d* are assembled to define a general rectangle that defines an aperture or opening 21 and an aperture or opening 23 as shown.

Figure 4:
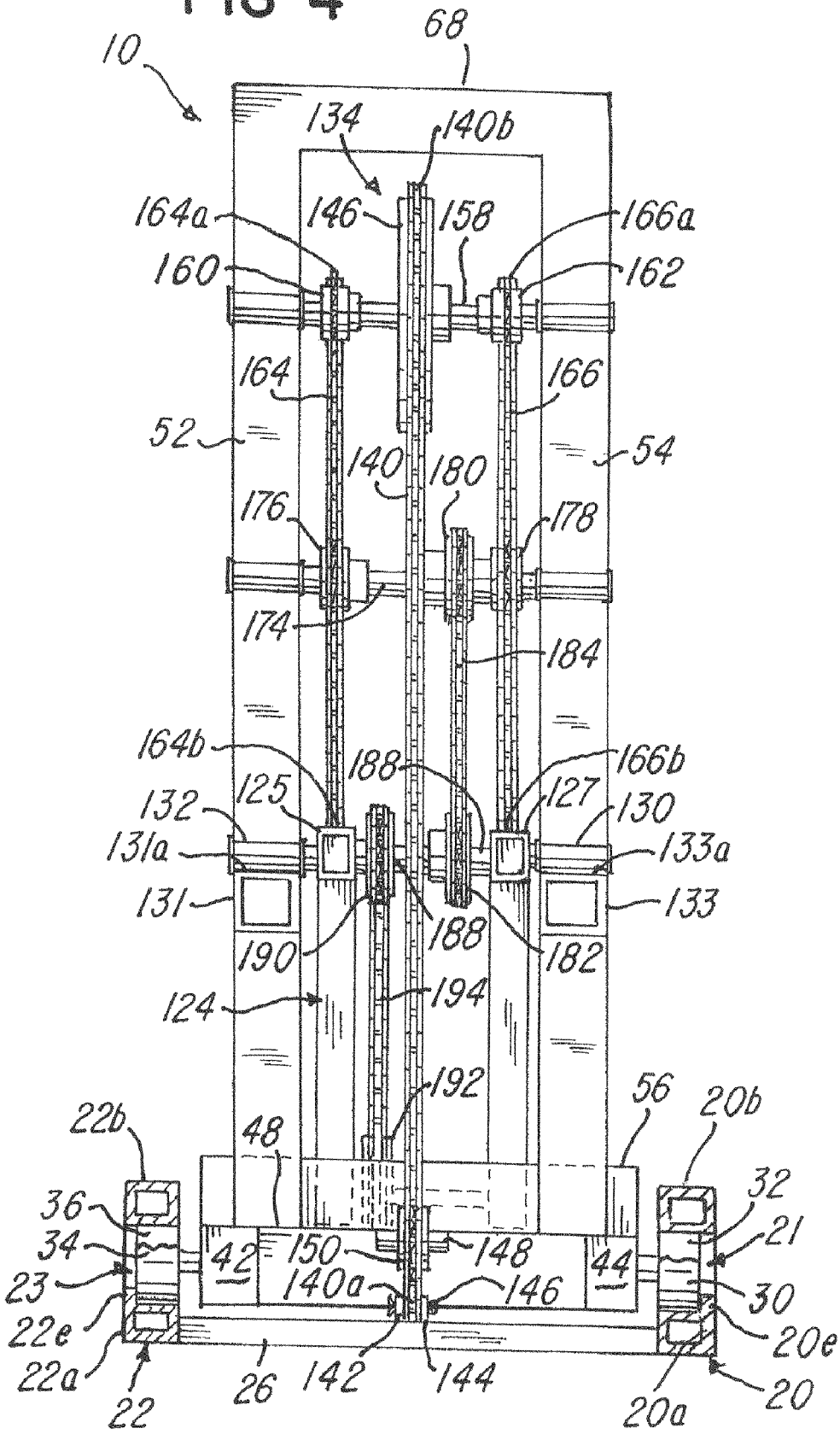
FIG. 4 is an end view illustrating a drive train used for driving a weight support in response to a player engaging the engagement member.

The first and second frame members 20 and 22 are coupled together with at least one or a plurality of cross frame members 24 and 26 as shown in FIG. 1. Note that the frame members 20 and 22 may each comprise a flange 20*e* and 22*e*, respectively, that cooperates with surfaces 20*a*1 and 22*a*1 to define a track area, channel or aperture 21 and 23, as best illustrated in FIGS. 1 and 4. The surface 20*a*1 receives a plurality of wheels 30 and 32 and surface 22*a*1 receives wheels 34 and 36, as illustrated in FIGS. 1 and 4. The plurality of wheels 30 and 32 are rotatably coupled to support member 44 and the wheels 34 and 36 rotatably coupled to support member 42 of the second support 14. The wheels 30-36 permit the second support 14 to roll or move generally parallel to the ground in the direction of double arrow A in FIG. 1. Thus, it should be understood that when a player, such as player P in FIG. 1, engages the engagement member 18, the second support 14 may move toward an end 12*a* of the first frame 12 as shown. It should be understood that the flange 20*e* facilitates retaining the wheels 30 and 32 in the aperture 21 and on the surface 20*a*1, while flange 22*e* facilitates retaining the wheels 34 and 36 in the aperture 23 and on the surface 22*a*1.

Notice in FIG. 1 that the first frame 12 comprises a plurality of support rods 35 and 37 for supporting and storing at least one or a plurality of weights 38 as shown.

Figure 3:
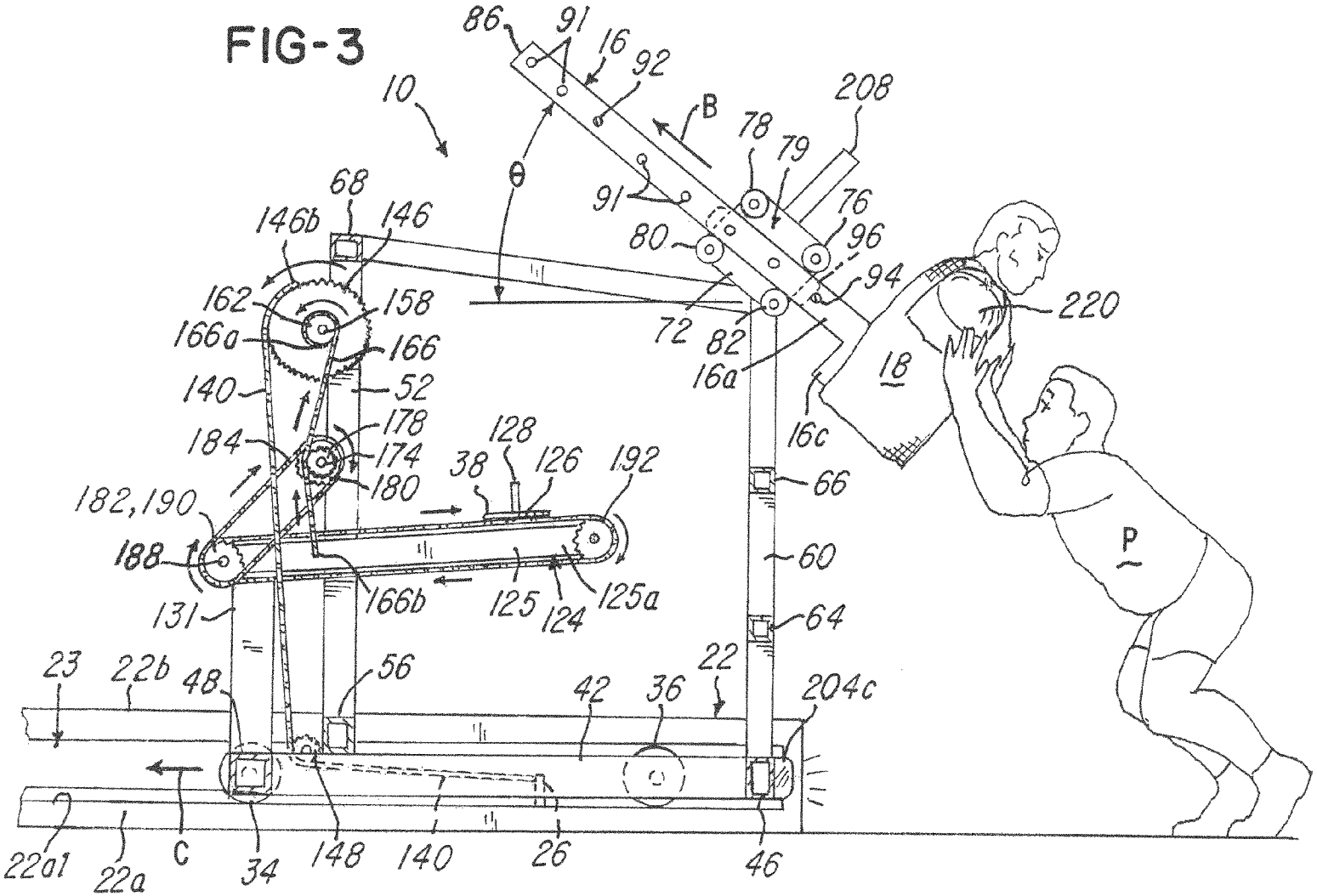
FIG. 3 is a view of a player engaging the engagement member and driving it upward (as viewed in the figure)

Referring now to FIGS. 1-3, the second frame 14 comprises a support base 40 comprising the pair of frame or support members 42 and 44 that are joined by support members 46 and 48 as shown. A first pair of vertical columns 52 and 54 is mounted, such as by weld, on a support member 56 that is mounted onto surfaces 42*a* and 44*a* of members 42 and 44, respectively, by conventional means such as a fastener or weld. Notice that the support frame member 68 couples the vertical columns 52 and 54 as shown.

A second pair of vertical support members 60 and 62 is mounted on surface 40*a* as shown. A pair of intermediate reinforcing frame or support members 64 and 66 are secured to the vertical support members 60 and 62 by conventional means, such as a weld or fastener. A support member 70 joins the vertical support members 60 and 62 to the support frame member 68 as shown. In the embodiment being described, the support member 70 is angled downward from left to right (as viewed in FIG. 2) and is coupled to the support frame member 68 by conventional means, such as a fastener or weld.

Figure 5:
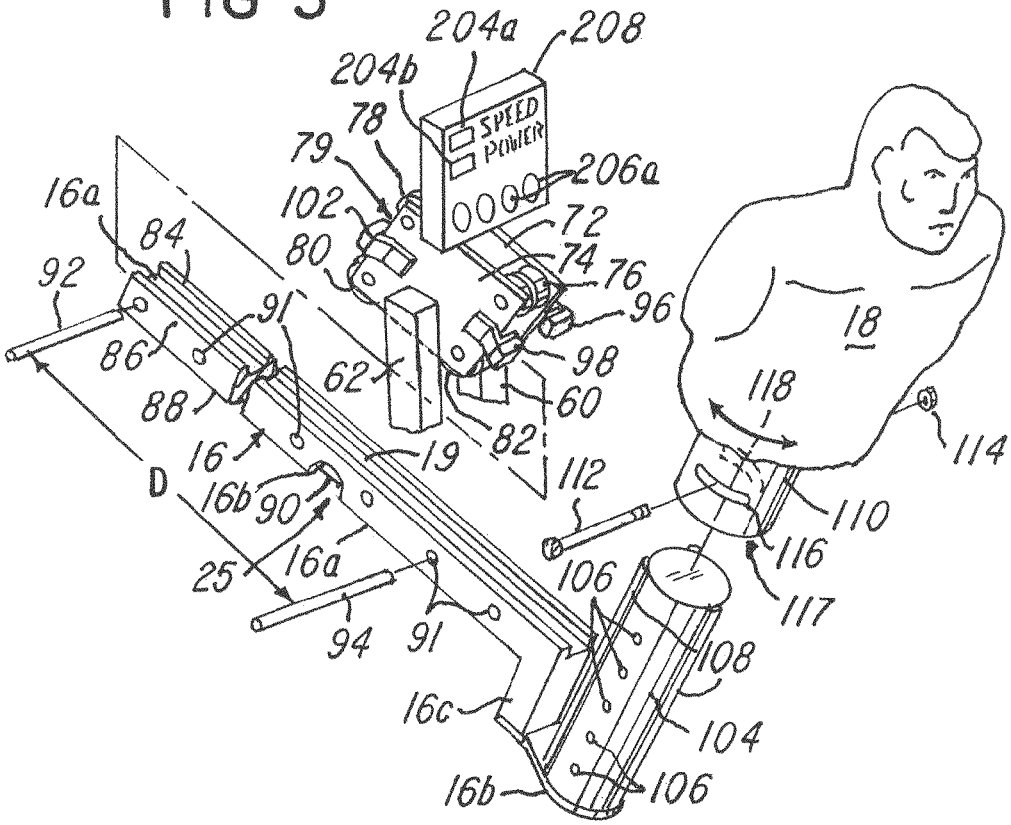
FIG. 5 is a perspective view illustrating various features of the embodiment shown in FIG. 1.

A pair of opposing plates or planar members 72 and 74 are secured, for example by a weld, to the vertical support members 60 and 62, respectively. The opposing plates or planar members 72 and 74 comprise and rotatably support a plurality of wheels 76, 78, 80 and 82 that cooperate to define a receiving channel or track 79 (FIG. 5) for receiving the elongated engaging member support 16 as shown. In this regard, notice that the elongated engaging member support 16 comprises a plurality of flanges 84, 86, 88 and 90 (FIG. 5). Note that the flanges 84 and 86 (FIG. 5) cooperate with the elongated support member 16*a* to define a track 19 for receiving and guiding wheels 76 and 78 as shown. Where flanges 88 and 90 cooperate with generally planar member 16*b* to define track 25 for receiving wheels 80 and 82.

In the embodiment being described, the engagement support member 16 comprises a plurality of apertures or holes 91 that receive a rod or stops 92 or 94, which may be a bolt. When the engagement member 18 is not being engaged, the stops 92 and 94 prevent the engagement member 18 from exiting the track 19. During use, the player P may engage the engagement member 18 and drive it in the direction of arrow B (FIG. 2) until the stop 94 engages a pair of stop pads 96 and 98. It should be understood that each of the rods or stops 92 and 94 may be removed and may be situated in any one of the apertures 91, which permits adjusting both a height F (FIG. 2) and a distance between the engagement member 18 and the player P. For example, for a player P desiring that the engagement member 18 simulate an opposing lineman, it may be desired to place the stop 92 in the aperture 91*a* so that the engagement member 18 is situated closer to the ground and the player P. If simulating a standing, opposing linebacker is desired, then the rod 92 may be situated in aperture 91*b* that is closer to the engagement member 18 so that the engaging member support 18 is situated farther from the player P and the ground.

Notice in FIG. 3 that the engaging member support 16 is situated at a predetermined angle theta Θ. In one example, the predetermined angle Θ may be approximately 45 degrees. In this regard, notice that the player P may engage the engagement member 18 and drive the engagement member 18 backward or in the direction of arrow B, as viewed in FIG. 3, until the rod or stop 94 engages the stop pads 96 and 98.

Substantially simultaneously or even prior to the stop 94 engaging the pads 96 and 98, the second support 14 may move in the direction of arrow C in FIG. 2 in response to the player P engaging the engagement member 18. In this regard, the wheels 30 and 32 rotatably move on the surface 20*a*1 in the track or aperture 21, while wheels 34 and 36 (FIG. 4) rotate or roll on the surface 22*a*1 in aperture 23, which permits the second support 14 be driven or move in the direction of arrow C (FIG. 2).

Thus, it should be understood that a distance D (FIG. 5) between the rods or stops 92 and 94 may be adjusted in order to adjust the travel of the engaging member support 16 between the pairs of wheels 76-78 and 80-82. For example, the rod or stop 94 may be situated in the aperture 91c so that the engaging member support 16 does not travel at all on the second support 14 (FIG. 2) when the engagement member 18 is engaged. In contrast, the rod or stop 94 may be situated in aperture 91*d* to permit a large amount of travel of the engaging member support 16 in response the player P engaging the engagement member 18.

Referring now to FIGS. 5-13, notice that the engaging member support 16 comprises an elongated support member 16*a*, a generally planar member 16*b* and a joining member 16*c* that joins the elongated support member 16*a* and generally planer member 16*b*. In the embodiment being described, the members 16*a* and 16*c* are tubular or solid members and the member 16*b* is generally planar and fastened to the member 16*c* by conventional means, such as by fasteners or a weld (not shown). Notice in FIG. 5 that the generally planar member 16*b* comprises an elongated male cylinder member 104 mounted or fastened thereto. The cylinder member 104 has a plurality of apertures 106 as shown. The elongated cylindrical member 104 may also comprise spacers or linear bearings 108, which in the embodiment being described are polymer or Teflon®. The linear bearings 108 are fastened to the cylindrical member 104 by conventional means such as by use of screw fasteners, adhesive (not shown) or the like.

Figure 6:
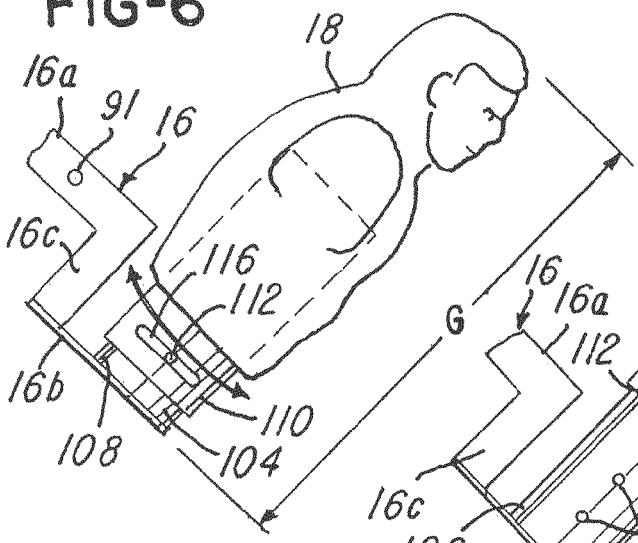
FIG. 6 is a view illustrating the engagement member and a first position.
Figure 7:
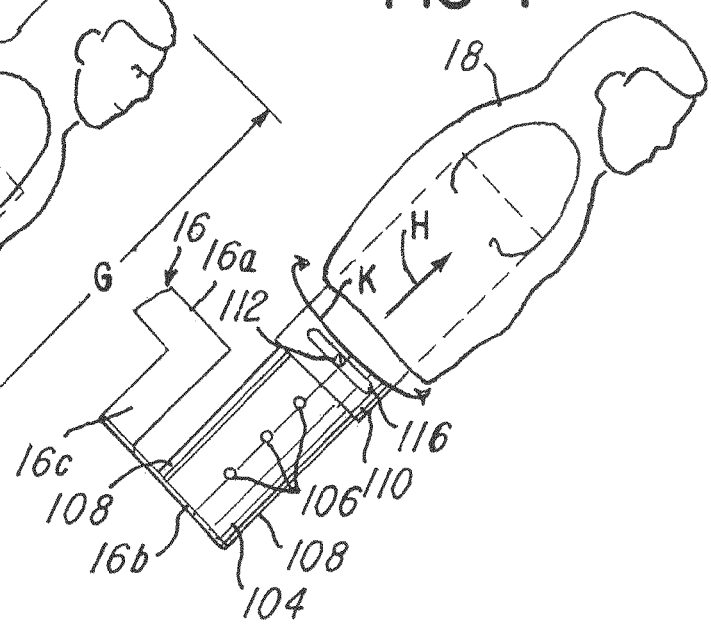
FIG. 7 is a view illustrating the engagement member in a raised position.
Figure 8:
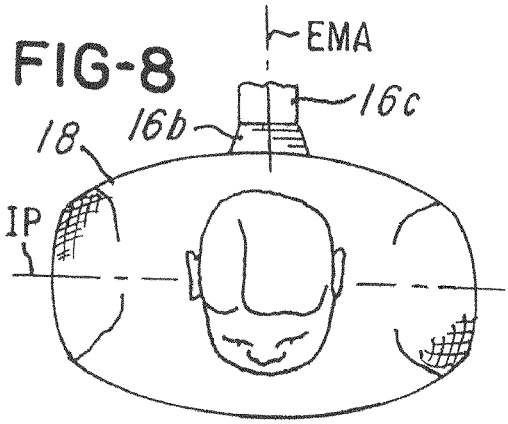
FIGS. 8-13 are various views of the engagement member showing its twisting, swiveling or pivotal movement about an axis of a cylinder that supports the engagement member.

In the embodiment being described, the engagement member 18 comprises a cylindrical female tubular member 110 that has a life-size or life-like dummy mounted or overmolded thereon. The tubular member 110 has an internal female area 117 (FIG. 5) that receives the cylindrical member 104, as illustrated in FIGS. 5-7. After the tubular member 110 receives the cylindrical member 104, the engagement member 18 is positioned over and receives the cylindrical member 104. A rod or locking member, such as a threaded bolt 112 and nut 114, are received in elongated slots or apertures 116 and 118 (FIG. 5) and through one of the apertures 106 and the cylindrical member 104.

The training system 10 comprises means for adjusting the distance F (FIG. 2) between the engagement member 18 and the ground, as well as an overall height or length G (FIG. 6) of the engagement member 18. Notice in FIGS. 6 and 7 that the position of the engagement member 18 along an axis of the cylindrical member 104 may be adjusted, for example, from the position shown in FIG. 6 upward in the direction of arrow H as shown. This is accomplished by aligning the slots or apertures 116 and 118 to the desired hole or aperture 106 and securing that relationship using the bolt 112 and nut 114.

Figure 9:
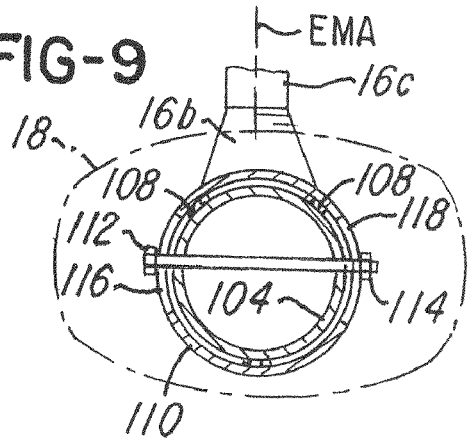
Figure 10:
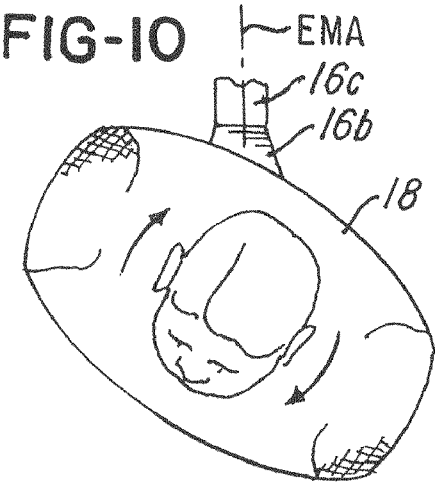
Figure 11:
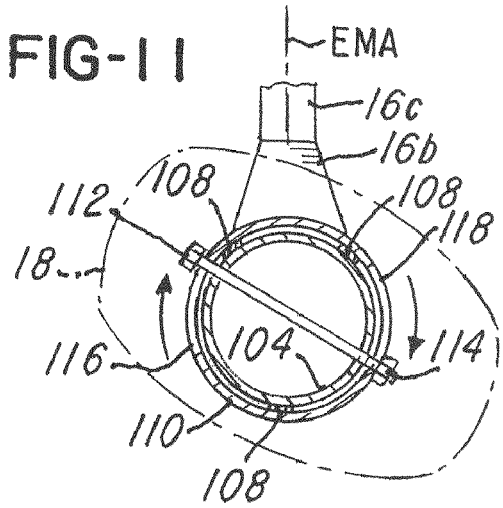
Figure 12:
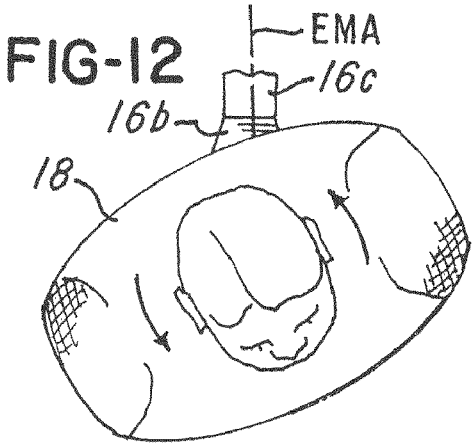
Figure 13:
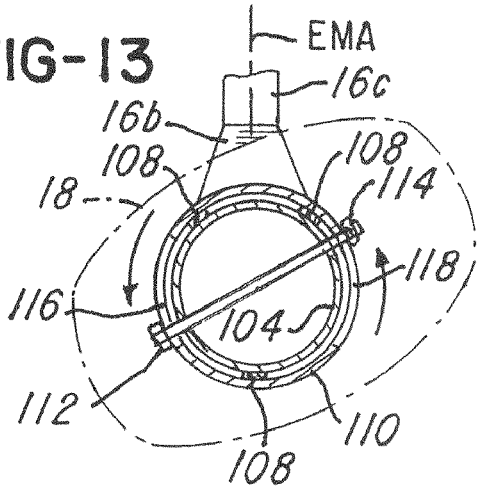

It should be understood that the slots or apertures 116 and 118 permit the engagement member 18 to swivel or pivot about an axis of the cylindrical member 104 in the direction of double arrow K (FIG. 7). This feature is further illustrated in FIGS. 8-13. Notice in FIG. 8 that the engagement member 18 is in the home position wherein the engagement member 18 faces directly the player P, as illustrated in FIG. 2. In this regard, the engagement member 18 may lie in an imaginary plane IP (FIG. 8) that is generally perpendicular to the engagement member axis EMA. FIG. 9 illustrates a fragmentary sectional view of the engagement member 18 in the home position. FIGS. 10 and 11 illustrate the engagement member 18 pivoting clockwise (when viewed from above), and FIGS. 12-13 illustrate the engagement member 18 pivoting or swiveling counter-clockwise as shown.

Advantageously, the training system 10 provides the engagement member 18 that not only moves in the direction of movement of the player P, but also simulates an opposing player by swiveling or pivoting in the manner illustrated in FIGS. 8-13. This facilitates the player practicing or training to block the opposing player or to "slide off" of a block of the opposing player, thereby enabling the player P to simulate and hone his skills in both an offensive and defensive game situation. The engagement member 18 may comprise a pair of shoulder pads 220 to further facilitate simulating a live engagement.

Referring now to FIGS. 4 and 14-16, the training system 10 further comprises a resistance system 120 or means for providing at least one of a variable or fixed resistance to the player P as the player P moves or engages the engagement member 18 and drives it in the direction of arrow C in FIG. 1. For example, notice that the second support 14 comprises a support rod 122 (FIG. 1) for supporting at least one or a plurality of the weights 38 as shown.

Figure 14:
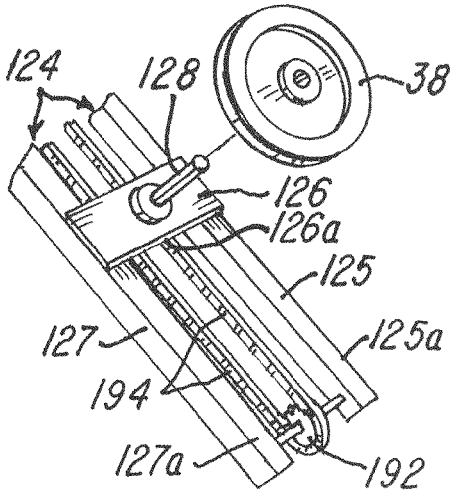
FIG. 14 is view showing a platform arm which one or more weights may be situated.

To provide variable resistance, the second support 14 comprises a pivoting support 124 that has a platform 126 (FIG. 14) on which a post 128 is mounted by conventional means, such as a fastener or weld. The post 128 receives at least one or a plurality of weights 38. The pivoting support 124 comprises an axle 188 (FIG. 15) that is mounted in sleeves 130 and 132 (FIG. 1) that are second to the surfaces 131*a* and 133*a*, respectively, of the L-shaped supports 131 and 133. The pivoting support 124 pivots or rotates in the direction of arrow N (FIG. 16) in response to the player P engaging the engagement member 18. For ease of description, FIGS. 14-16 are simplified views to illustrate the operation of the resistance system 120.

Figure 15:
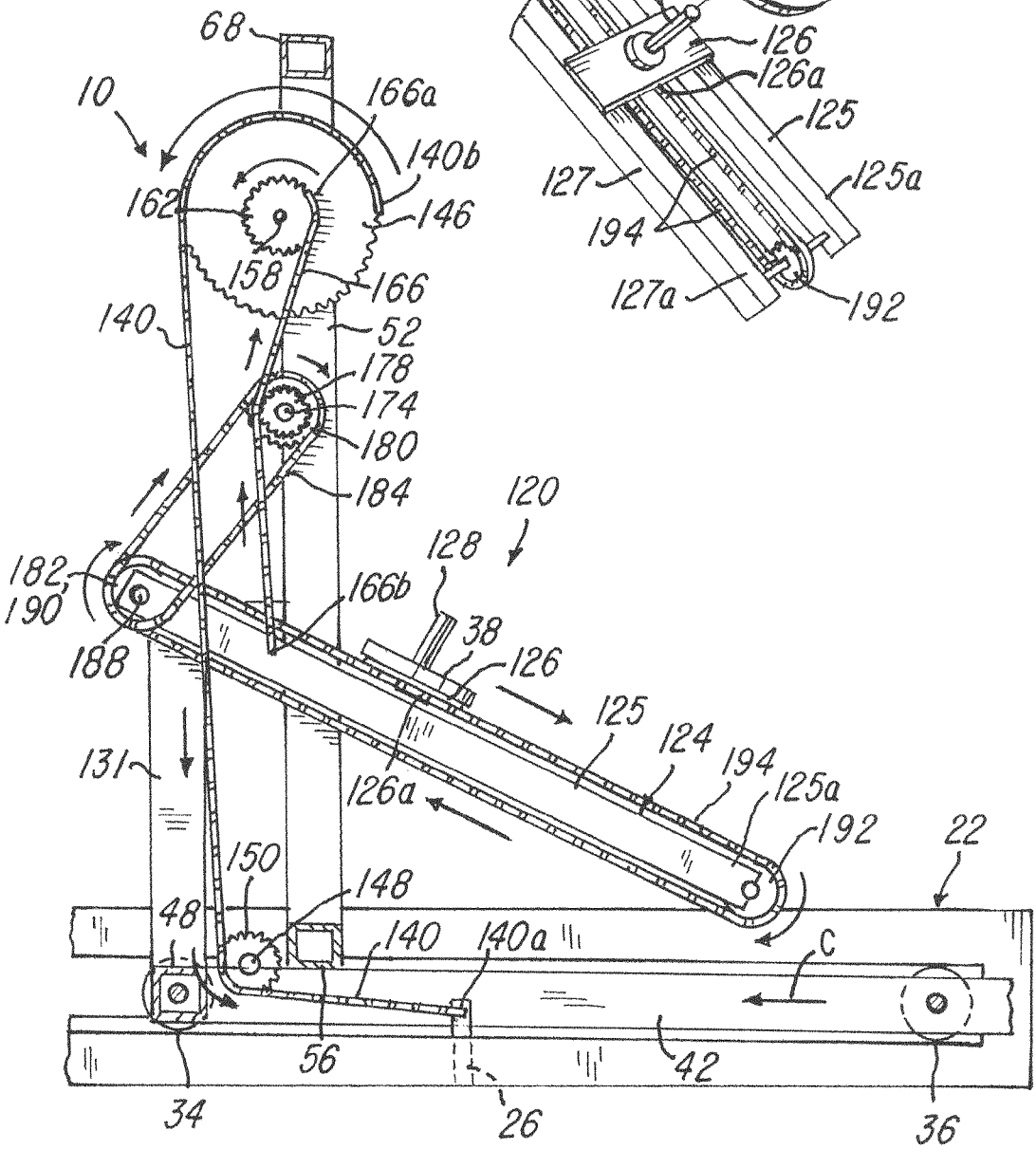
FIG. 15 is a view illustrating a platform support in a lowered position.
Figure 16:
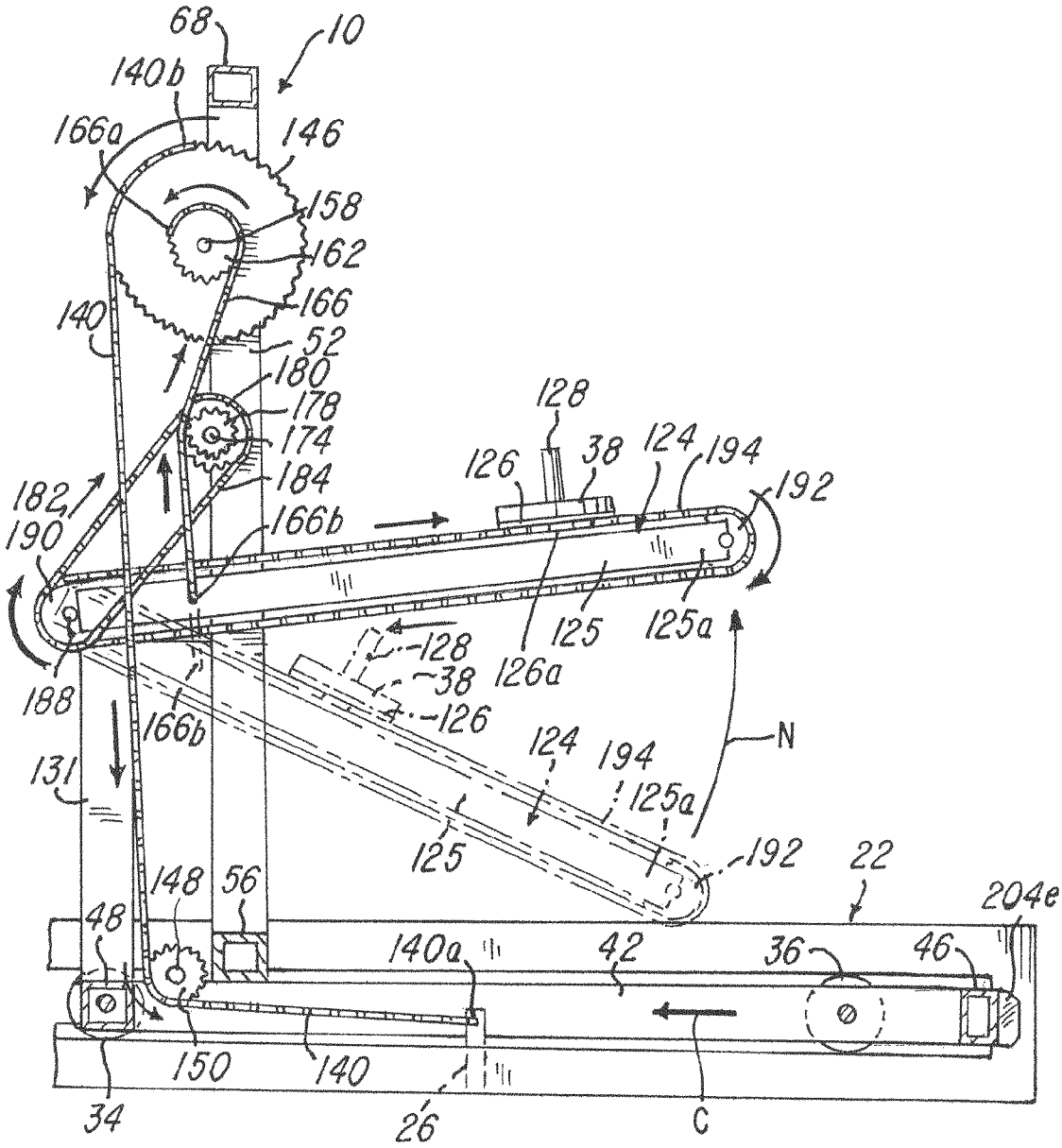
FIG. 16 is a view similar to FIG. 15 illustrating the platform in a raised position to provide increased resistance to the player as the player engages the engagement members.

The resistance system 120 comprises a drive train 134 (FIG. 4) which causes the pivoting support 124 to pivot about the axis of axle 188 so that the ends 125*a* and 127*a* (FIGS. 14 and 15) pivot in the direction of double arrow N (FIG. 16) and substantially simultaneously the platform 126 and any weight thereon can move toward the ends 125*a* and 127*a*, as viewed in FIGS. 15 and 16. One function of the resistance system 120 is to provide increased resistance by raising the end 124*a* upward (as illustrated in FIGS. 15 and 16) as the pivoting support 14 is driven in the direction of arrow C (FIGS. 15 and 16). Substantially simultaneously and as the ends 125*a* and 127*a* are being raised, the platform 126 moves on the pivoting support 124 toward the ends 125*a* and 127*a*, thereby providing increased resistance to the player P as the player P engages the engagement member 18 and drives it upward (as viewed in FIG. 1) and rearward.

To perform the function of raising the ends 125*a* and 127*a* of the pivoting support 124, the resistance system 120 comprises a primary drive chain 140 that has an end 140*a* secured to the at least one or a plurality of cross frame members 26 that is mounted between a pair of flanges 142 and 144 (FIG. 4) and secured thereto with a cotter pin, nut or bolt 146.

As best illustrated in FIGS. 4, 15-16 the other end 140*b* of the chain 140 is secured to a sprocket 150 as illustrated. The chain 140 is also engaged by a sprocket 150 that is mounted on an axle 148, as illustrated in FIGS. 1 and 4. As the second support 14 is driven in the direction of arrow C (FIGS. 15 and 16), the sprocket 150 drives the shaft or axle 158. Notice that the axle 158 (FIG. 4) comprises a pair of sprockets 160 and 162 that are mounted on either side of the sprocket 150 as shown. As the axle 158 is rotated, the sprockets 160 and 162 rotate in the counter-clockwise direction in response thereto, as viewed in FIG. 15.

Notice that drive chains 164 and 166 have ends 164*a* and 166*a* that are mounted to the sprockets 160 and 162, respectively, as shown. Second ends 164*b* and 166*b* are mounted, for example, by a screw, or nut and bolt or other suitable fastener to the legs or elongated support members 125 and 127, respectively, of the pivoting support 124.

Notice that an intermediate axle 174 is provided having two sprockets 176 and 178 that are aligned with, driven by and responsive to the drive chain 164 and 166, respectively, as shown in FIGS. 4 and 15-16. The axle 174 (FIG. 4) further comprises another drive sprocket 180 that is coupled to a sprocket 182 by a drive chain 184. In the embodiment being illustrated, the sprocket 182 is fixed to the axle 188, as well as the members 125 and 127 of the pivoting support 124 such that when the axle 188 is driven by the sprocket 182, which in turn is driven by the drive chain 184 in response to the rotation of the sprocket 180. When the axle 188 is rotatably driven, the sprocket 190, which is also mounted on the axle 188, rotatably driven in response thereto. Notice that the pivoting support 124 comprises a sprocket 192 (FIG. 14) that generally opposes sprocket 190 and is coupled thereto by a drive chain 194. The drive chain 194 is fastened or secured to an underside 126*a* of the platform 126 so that when the chain 194 is driven, the platform 126 is also driven in response thereto.

In the illustration being described, as the player P engages the engagement member 18 and the second support 14 is driven in the direction of arrow C, the primary drive chain 140 rotates the sprocket 150, which in turn rotatably drives the sprockets 160 and 162. The sprockets 160 and 162 collect their respective drive chains 164 and 166 which causes the ends 125*a* and 127*a* of the supports 125 and 127 to move or be raised from the position illustrated in FIG. 15 to the position illustrated in FIG. 16. Substantially simultaneously, the drive chains 164 and 166 drive the axle sprockets 176 and 178, respectively, which in turn rotate or drive the axle 174 and the sprocket 180. The drive chain 184, which couples sprocket 180 to sprocket 182, causes the sprocket 182 to rotate which in turn drives the axle 188.

The rotation of the axle 188 drives the sprocket 190 which in turn drives the drive chain 194 to cause the platform 126 and any associated weight thereon, such as weight 38 illustrated in FIG. 14, to move forward toward the player P or in a direction from left to right (as viewed in FIGS. 14-16), thereby causing the platform 126 to move toward the end 125*a* (FIG. 14). Moving the weight 38 toward the ends 125*a* and 127*a* and movement of the weight in a direction opposite the direction the player P is moving the second support 14, provides more resistance to the player P as the player P moves or drives the engagement member 18 in the direction of arrow C (FIG. 3), thereby providing a generally increasing amount of resistance to the player P.

Referring back to FIG. 1, the training system 10 further comprises performance measuring means or a performance measurer 200 comprising a control circuit or controller 202 which is coupled to a display 204 or means for visually displaying information and an audio device or audio means 206 for providing audio information as described herein. In the embodiment being described, the control circuit or controller 202 may be arranged and assembled in accordance with the drawings shown in FIG. 17.

In general, player P in FIG. 1 assumes a ready position. Then at a random time, intended to surprise the player, a "go" signal is issued, whereupon the player attacks dummy 18, moving the dummy 18 from the position shown in FIG. 2 to that of FIG. 3. During this movement, weights 38 are lifted, because of the effort of player P.

The invention computes (1) the reaction time of the player P, (2) the speed with which he moves the dummy 18, (3) the power with which he attacks the dummy, as indicated by the weight of weights 38 and the speed at which they are lifted, as well as other parameters, and displays these parameters to the player P.

Figure 17:
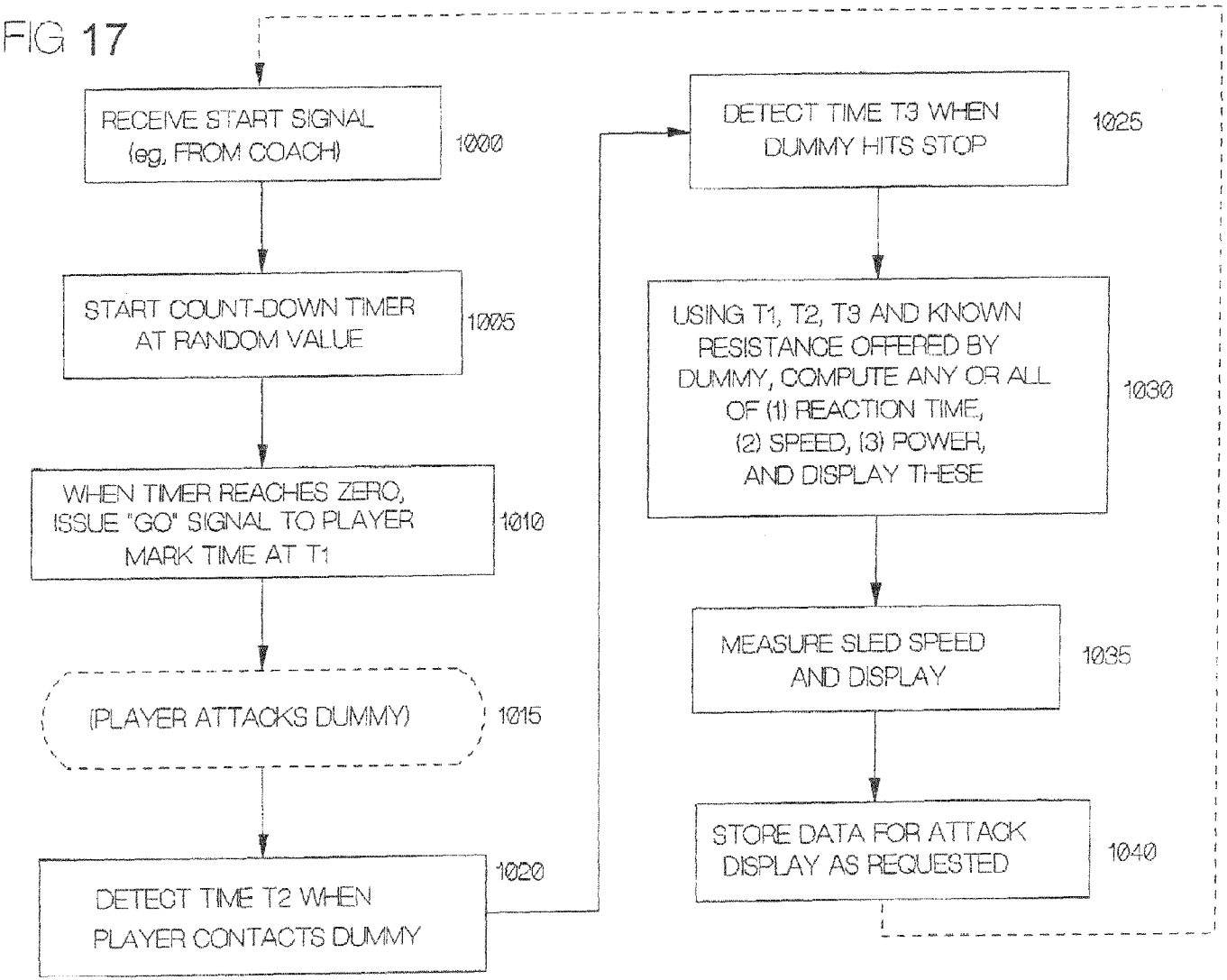
FIG. 17 is a schematic diagram of a control circuit in accordance with one embodiment of the invention.

FIG. 17 is a flow chart illustrating processes undertaken by one form of the invention, particularly by the controller 202 in FIG. 1. These processes can be undertaken by microprocessors or small computers, plus associated sensors and data-conditioning circuitry, all known in the art.

Because of the low cost of modern personal computers, one embodiment of the invention contemplates using a personal computer for the computation described herein, the display of the computer for displaying data. Sensor input to the computer can be achieved using known data-acquisition cards, such as those available from Keithley-Metrabyte, for example.

In block 1000 of FIG. 17, a start signal is received by the controller 202, and can originate with the coach (not shown) of player P in FIG. 1. For example, the coach may flip a switch on a wireless transmitter in his hand, which issues a start-signal to the controller 202 in FIG. 1.

When the start signal is received, block 1005 in FIG. 17 indicates that a count-down timer is set at a random value, which is not disclosed to the player P. For example, the random value may range from 2.5 to 7.5 seconds. This count-down process of unknown duration simulates the time during which a quarterback issues calls to the center, prior to the snap of the ball. The time when the count-down timer reaches zero should be a surprise to the player P.

Block 1010 indicates that, when the count-down timer reaches zero, a "go" signal is issued to the player. As explained herein, the "go" signal can take the form of a flashing light, a buzzer, a simulated voice, or other signal. The components issuing the "go" signal are represented by blocks 204 and 206 in FIG. 1.

In addition, the time when the "go" signal is issued is marked as time T1 as block 1010 indicates.

When player P detects the "go" signal, he attacks the dummy 18 in FIG. 2. When the player P makes contact with the dummy 18, one or more sensors detect the contact, and mark the time of contact as time T2, as indicated by block 1020 in FIG. 16.

Contact with the dummy can be detected in numerous ways. For example, as discussed above, an accelerometer can be attached to the dummy 18. When the dummy 18 moves, an acceleration will occur, which can be detected by associated circuitry.

It may be desirable to include a type of filter, to suppress spurious acceleration. For example, if a heavy truck were to roll by the player P, the truck may shake the ground and trip a sensitive accelerometer. Also, the coach may wish to ride the apparatus to which the dummy 18 is attached, because otherwise the player P will move away from the coach during attacks, especially repeated attacks, making it difficult for the coach to issue instructions to the player P. Normal body movement of the coach-passenger may trip the accelerometer.

Other approaches are possible to detect contact between the player P and the dummy 18. For example, a detector (contact or non-contact) may be trained on a specific spot on engaging member support 16 in FIG. 2. As a specific example, the lever of a stationary micro-switch may rest on a boss (neither shown) attached to engaging member support 16. When support moves a specific distance, such as ¼ inch, along arrow B in FIG. 2, and to the left in the figure, the boss will move past the lever of the micro-switch, thereby tripping the switch. This trip of the switch, indicating movement of engaging member support 16, can be used to infer contact between the player P and the dummy 18.

As another example, a chest plate (not shown), somewhat analogous to body armor, may be attached to the dummy 18. When the chest plate is moved toward the body of the dummy, a sensor may detect that movement, and infer contact by the player P. This sensor may resemble the floor switches used by supermarkets to detect a customer, and open an entry door in response.

At this time, the dummy is moving in the direction of arrow B in FIG. 3.

Block 1025 in FIG. 17 indicates that a time T3 is marked when the dummy 18 hits a stop. For example, as in FIG. 3, stop 94 has reached stop pad 96, which acts as the stop. The accelerometer discussed above can be used to detect this event. It is pointed out that, in general, this event will produce an deceleration signal which is much larger than the acceleration signal produced when the player P strikes the dummy 18. One reason is that the deceleration will be more abrupt.

Block 1030 in FIG. 17 indicates that the times T1, T2, and T3 are used to compute various parameters. The difference between T2 and T1 is, of course, the reaction time of the player P. It is the time between (1) the "go" signal and (2) initial contact with the dummy 18.

Speed of the player P can be computed. The difference between T3 and T2 indicates the time required by the dummy to move between the positions shown in FIGS. 2 and 3. Knowledge of the distance between the positions and the time elapsed to cover that distance allows computation of the speed at which the dummy 18 moved in the direction of arrow B in FIG. 3. Of course, this is an average speed between times T2 and T3. Also, if the sled is moving during this time, the speed of the dummy 18, by itself, does not indicate the speed of the player P.

Power delivered by the player can be computed. As shown in FIGS. 2 and 3, weights 38 are lifted because of the travel of the dummy 18 in the direction of arrow B in FIG. 4. As a simple example, if (1) the weights 38 total 100 pounds, (2) they are raised one foot during the interval between T2 and T3, (3) the interval between T2 and T3 is 0.2 seconds then, ignoring losses in the system such as friction, the player P has developed 100 foot pounds in the 0.2 second interval. That is equivalent to 500 foot pounds per second, or nearly one horsepower for that time period, since one horsepower is about 550 foot-pounds per second.

One illustrative way to calculate the force or power rating is to calculate an average number based on various input variables. For example, one average number may correspond to an average number, the numerator of which is the sum of at least one of the following N number of variables:

(1) a first number corresponding to an initial hit force;

(2) a second number associated with an impact force that the player engages the engagement member; or (3) a speed at which the second frame moves over a given time, and wherein the denominator is the total number of variables selected to determine the numerator.

Block 1030 indicates that the parameters computed are displayed. The display allows the coach and the player to learn (1) reaction time, (2) player's speed, and (3) power delivered during the attack.

Block 1035 indicates that the speed of the sled is measured and displayed. As explained above, a wheel 30 may be used to measure ground speed of the sled, and this speed is measured and displayed.

Block 1040 in FIG. 17 indicates that the measured parameters are stored for the attack just completed. These can be stored in a queue, for example, in LIFO, Last In First Out fashion. When the queue becomes full, the data concerning the earliest attacks is dropped. This allows a player to execute a sequence of, say, five attacks. His parameters are stored for attacks A1 through A5. When he requests a display of the sequence, they are presented in order of A5 through A1. Of course, other orders of display are possible.

Some additional considerations are the following.

The system may not undertake all the processes indicated in FIG. 17. Input switches or a keypad (not shown) may allow the user to select specific processes of interest, at any given time. For example, the user may only wish to compute reaction time. In that case, only reaction time is computed and displayed. Speed and power are not.

In the case when a personal computer is used for the computation, a detailed interface can be presented to the user, allowing the user to select from among dozens of different options offered. Such options may include, for example, date of practice, speed data, top hit data, number of times hit during a period (e.g., one day), history of use information, number of repetitions and progress information such as an increase in hit force over time and the like.

In the general case, it is contemplated that the user is given the option of selecting any combination of processes in FIG. 17 to be performed, and any combination of parameters to be computed, such as times, speeds, and power. This can be accomplished by issuing simple codes, as by rotary switches or keypads, to the microprocessor which computes the data, or by the interface described above.

It was stated above that the computed speed of the player is an average speed, based on the difference between T3 and T2. However, in an embodiment using an accelerometer, a more precise computation of speed is possible.

For a constant acceleration, current speed equals acceleration x time. For a non-constant acceleration, current speed is the integral, in the calculus sense, of acceleration over time.

Of course, if acceleration terminates before the stop 94 reaches the stop pad 96 in FIG. 3, speed will remain constant after the termination. Nevertheless, the accelerometer allows the system to provide detailed data as to the instantaneous speed of the dummy 18. As one example, instantaneous speed can be measured every 1/100 second.

It is pointed out that the speeds discussed above are speeds of the dummy 18, travelling in the direction of arrow B in FIG. 3. That is not the same as the player's horizontal speed. However, the horizontal speed can be deduced by taking the speed component of dummy 18 which is parallel to the ground.

In one mode of operation, the user tells the controller 202 in FIG. 1 as to undertake a sequence of attacks, or hits. In response, the controller 202 (1) issues a "go" signal, (2) reads the data from the player's attack, (3) computes the time/speed/power parameters, (4) displays the parameters for a specified time period, such as one second, then (5) issues another "go" signal, and so on. Thus, the system can operate in a sequence-of-hits mode, as just described, or a single-hit mode.

The control circuit or controller 202 may be provided on a board (not shown) and mounted in the housing 208 having the displays 204*a* and 204*b* which are mounted in a housing 208. Also, the display 204 may comprise at least one or a plurality of displays 204*a* and 204*b* and/or audio devices 206 that are mounted in a housing 208, as illustrated in FIGS. 1 and 5, and coupled to the control circuit or controller 202. In the embodiment being described, the displays 204*a* and 204*b* may be conventional liquid crystal displays (LCD) or light emitting diodes (LED). The visual display 204 may further comprise one or more audio or visual signaling devices 204*c* that are mounted on either the first support 12 or second support 14. Note also the audio device 206 may comprise a plurality of speakers 206*a* coupled to controller 202 for providing audio communication, as illustrated in FIG. 3.

In the illustration being described, the training system 10 may comprise at least one or a plurality of sensors, such as sensors 210 and 212. In the embodiment being described, the sensor 210 comprises an accelerometer, Model No. ADXL available from Analog Devices of Norwood, Mass., mounted in the engagement member 18. The sensor 210 senses an impact by the player P and provides a signal to the controller 202 in response thereto. When the player P moves or drives the engagement member 18 until the stop 94 engages the pads 96 and 98, the sensor 210 or accelerometer generates a second signal corresponding to an increased resistance when the stop 94 engages the pads 96 and 98.

The control circuit or controller 202 receives the first and second signals and generates at least one or a plurality of player measurements or useful information in response thereto. For example, the control circuit or controller 202 may initially generate a "go", "hike" or "hut . . . hut" audio signal through speakers 206*a* upon which the player P begins the training procedure. When the player P engages the engagement member 18 the sensor 210 generates the aforementioned first signal in response thereto. The controller 202 uses the begin and first signal to calculate a speed or time duration that it took the player P to engage the engagement member 18 after receiving the "go", "hike" or "hut . . . hut" signal.

As the player P drives the engagement member 18 backward until the stop or rod 94 engages the pads 96 and 98, the sensor 210 generates the second signal. The controller 202 uses the first and second signals and provides a measurement of the speed at which the engagement member 18 stops relative to the second support 14. This provides an indication of a force or power at which the player P has driven the engagement member 18 at the time it engages the pads 96 and 98.

The controller 202 uses the speed and power signals or sensed signals to generate a speed rating that is displayed on display 204*a* and a power rating that is displayed on display 204*b* to provide a plurality of player measurements that enable a comparison of one training episode to another training episode involving the same or different player P. Thus, the performance measurer 200 enables measuring, monitoring and improving a player's performance by the player, a coach or a trainer.

In one embodiment, the sensor 210 may be mounted on the cylindrical member 104 or even integrally molded in the engagement member 18.

The training system 10 may also comprise the second sensor 212 that is coupled to the controller 202. In the illustration being described, the second sensor 212 is a rotary sensor Model No. RV24A-10-15F-B5K available from Alpha of Taoyuan, Taiwan, associated with wheel 30 that measures a speed of rotation of the wheel and thereby gives an indication of the speed at which the second support 14 is moved relative to the ground. This, in turn, gives an indication of how fast the player P is driving the engagement member and/or second support 14.

Advantageously, engagement member 18 comprises a life-like or life-size dummy of at least a bust of a person, such as an opposing football player. In one embodiment, the engagement member 18 may comprise integrally molded pads or external pads (not shown) that simulate or constitute the shoulder pads 220 (FIG. 3) actually worn by an opposing player. In the illustration being described, the life-size dummy comprises a one-piece polymer or rubber construction that is mounted or overmolded onto tubular member 110.

Advantageously, the training system 10 provides means for training a player and improving a player's skills in movement relative to another player (not shown) which is represented or simulated by engagement member 18. During operation, the performance measurer or measurement means 200 may comprise a countdown timer, reset or start button 214 which a player, coach or trainer may use to initiate the training episode. In this regard, the countdown timer or start button may, after a predetermined period such as four seconds or even a random period, generate a signal which the control circuit or controller receives and generates an audio signal, such as a "go", "hike", "hut . . . hut" exclamation or the like. Although not shown, audio may be generated or broadcast through speakers 206*a* that simulates or replicates or provides a recording of, for example, an opponent's quarterback's voice and inflection to provide a realistic game-like experience.

The player P responds to the audio information by "firing out" in the direction of arrow C (FIGS. 15 and 16) and engaging the engagement member 18 and driving the engagement member 18 until the stop 94 engages the pads 96 and 98. Substantially simultaneously or upon the stop 94 engaging the pads 96 and 98, the second support 14 begins moving in the direction of arrow C (FIG. 15), whereupon resistance members begin providing increased resistance in the manner described earlier herein relative to FIGS. 4 and 14-16. Substantially simultaneously or even after the player P has driven the second support 14 as far as he or she can or to the end of the left-most end of the apertures 21 and 23 (as viewed in FIG. 1), the performance measurer 200 generates the speed and displays the speed rating or measurement on the display 204*a*. Substantially simultaneously, performance measurer 200 provides a power rating, which is displayed by display 204*b*.

As mentioned earlier herein, the speed rating displayed on 204*a* may be directly related to the speed or time it took the player P to engage the engagement member 18 and drive it until the stop 94 engaged the pads 96 and 98 (FIG. 5). The power rating corresponds to the acceleration or speed at which the engagement member 18 impacts the pads 96 and 98, which in turn provides a correlation to the force or power at which the engagement member 18 is being driven upward by the player P. As mentioned earlier, the second sensor 212 measures the speed at which the engagement member 18 and second support 14 are being driven in the direction of arrow C. This speed may also be displayed on display 204*a*.

Advantageously, the training system 10 provides means and apparatus for measuring the initial contact speed at which a player P engages the engagement member 18, a force at which the player P has driven the engagement member 18, and also a speed at which the player P is driving at least one of the engagement member 18 and/or the second support 14 in the direction of arrow C in FIG. 1. As mentioned earlier, the movement of the second support 14 by the player P causes the resistance system 120 to simultaneously provide increased resistance to the player P as the player drives or moves the second support 14. As mentioned earlier, the amount of resistance can be increased or decreased by providing more or less weight, such as weights 38 on the support post 128 and/or support rod 122.

While the apparatus and method herein described, and the form of apparatus for carrying this method into effect, constitute preferred embodiments of this invention, it is to be understood that the invention is not limited to this precise method and form of apparatus, and that changes may be made in either without departing from the scope of the inventions, which is defined in the appended claims.

What is claimed is:

1. A training system comprising:

a first frame;

a second frame moveably mounted on said first frame so that said second frame can move in a first predetermined direction on said first frame; and an engaging member moveably mounted on said second frame so that said engaging member can move on said second frame in a second predetermined direction and independently of movement of said second frame on said first frame;

said second frame adapted to move from a second frame home position in said first predetermined direction when a player engages said engaging member and said engaging member adapted to move from an engaging member home position in said second predetermined direction in response to said player engaging said engaging member;

wherein said engaging member and said second frame are adapted to move independently and said first predetermined direction is different from said second predetermined direction, said first predetermined direction being generally forward and said second predetermined direction being upward and at an acute angle relative to the ground.

2. The training system as recited in claim 1 wherein said training system further comprises a performance measurer comprising at least one display for displaying at least one of a time or speed at which said player engages said engaging member or a force at which said player engages said engaging member.

3. The training system as recited in claim 1 wherein said training system further comprises:

a performance measurer for providing a player measurement for measuring a performance of said player.

4. The training system as recited in claim 3 wherein said player measurement generally corresponds to a time or speed associated with said player engaging said engaging member.

5. The training system as recited in claim 3 wherein said player measurement generally corresponds to a force or power rating.

6. The training system as recited in claim 3 wherein said engaging member is a substantially life-size dummy defining at least an artificial bust of a human.

7. The training system as recited in claim 6 wherein said substantially life-size dummy comprises football shoulder pads.

8. The training system as recited in claim 6 wherein said substantially life-size dummy comprises a one-piece polymer or rubber construction.

9. The training system as recited in claim 1 wherein said system further comprises:

a resistance system for providing resistance as said player moves said engaging member away from said engaging member home position.

10. The training system as recited in claim 9 wherein said resistance increases at an increasing rate as said player moves said engaging member away from said engaging member home position.

11. A training system comprising:

a first frame;

a second frame moveably mounted on said first frame; and an engaging member moveably mounted on said second frame;

said second frame adapted to move from a second frame home position in a first predetermined direction when a player engages said engaging member and said engaging member adapted to move from an engaging member home position in a second predetermined direction in response to said player engaging said engaging member;

wherein said first predetermined direction is different from said second predetermined direction;

wherein said system further comprises:

a resistance system for providing resistance as said player moves said engaging member away from said engaging member home position;

wherein said second frame comprises a weight support for supporting weight, said resistance system further comprising:

a drive chain coupling said first frame, said second frame and said weight support such that when said player moves said engaging member away from said engaging member home position, said weight moves on a second member to provide an increased amount of resistance to said player.

12. The training system as recited in claim 1 wherein said engaging member is pivotally mounted on an engaging member support that is moveably mounted on said second frame.

13. The training system as recited in claim 12 wherein said second frame comprises a plurality of wheels defining a track, said engaging member support comprising a substantially linear support member for receipt in said track;

said linear support member comprising at least one support column on which said engaging member is pivotally mounted.

14. The training system as recited in claim 1 wherein system comprises a height adjuster for adjusting a distance between said engaging member and the ground.

15. The training system as recited in claim 1 wherein said engaging member is adapted to move in a direction that is not parallel to the ground in response to said player engaging said engaging member.

16. The training system as recited in claim 15 wherein said engaging member is situated at a predetermined angle such when said engaging member is engaged, it moves generally upward along a path that diverges from the ground at a predetermined angle.

17. The training system as recited in claim 1 wherein said engaging member is moveably mounted to said second frame such that when said engaging member is engaged, it moves generally upward along a path that diverges from the ground at a predetermined angle.

18. The training system as recited in claim 16 wherein said predetermined angle is at least 45 degrees.

19. The training system as recited in claim 1 wherein said system comprises a first sensor associated with said engaging member for measuring a first impact and a second impact, said first impact generally occurring in response to said player engaging said engaging member and said second impact corresponding to when said engaging member reaches a second position.

20. The training system as recited in claim 19 wherein said second position corresponds to when said engaging member stops moving relative to said second frame.

21. The training system as recited in claim 1 wherein said system comprises a second sensor for measuring at least one of a speed at which said engagement member moves or a distance said engagement member moves.

22. The training system as recited in claim 20 wherein said system comprises a second sensor for measuring at least one of a speed at which said engaging member moves or a distance said engaging member moves.

23. The training system as recited in claim 1 wherein said system comprises a second sensor for measuring both a speed at which said engaging member moves and a distance said engaging member moves.

24. A football training system comprising:

a base;

a first support moveably mounted on said base;

a second support moveably mounted on said first support so that said second support can move in a first direction on said first support; and an engaging member support for supporting an engaging member above the ground, said engaging member support being adapted to move on said second support in a second direction independently of said movement of said second support on said first support;

said engaging member being adapted to move away from the ground along a path that cooperates with the ground to define a predetermined angle and said second support also being adapted to move on said first support, said movement of said engaging member being forward and upward at an acute angle relative to the ground.

25. The football training system as recited in claim 24 wherein said football training system comprises:

a resistance system secured to at least one of said first support, said second support or said engaging member support to provide increased resistance to the player as the player moves the engaging member.

26. The football training system as recited in claim 24 wherein said football training system comprises:

a resistance system secured to said first support and said second support to provide increased resistance to the player as the player moves the engaging member.

27. The football training system as recited in claim 24 wherein said football training system further comprises a performance measurer comprising at least one display for displaying at least one of a time or speed at which a player engages said engaging member or a force at which said player engages said engaging member.

28. The football training system as recited in claim 24 wherein said football training system further comprises:

a performance measurer for providing a player measurement for measuring a performance of a player.

29. The football training system as recited in claim 28 wherein said player measurement generally corresponds to a time or speed associated with said player engaging said engaging member.

30. The football training system as recited in claim 28 wherein said player measurement generally corresponds to a force or power rating associated with a player moving said engaging member from a home position to a second position.

31. The football training system as recited in claim 30 wherein said force or power rating corresponds to an average number, the numerator of which is the sum of at least one of the following N number of variables:

(1) a first number corresponding to an initial hit force;

(2) a second number associated with an impact force that the player engages said engaging member; or (3) a speed at which a second frame moves over a given time, and wherein a denominator is the total number of variables selected to determine said numerator.

32. The football training system as recited in claim 24 wherein said engaging member is a substantially life-size dummy comprising an artificial bust.

33. The football training system as recited in claim 32 wherein said substantially life-size dummy comprises football shoulder pads.

34. The football training system as recited in claim 32 wherein said substantially life-size dummy comprises is a one-piece polymer or rubber construction.

35. The football training system as recited in claim 24 wherein said system further comprises:

a resistance system coupled to at least one of said first support, said second support or said engaging member support for providing resistance as a player moves said engaging member away from an engaging member home position.

36. The football training system as recited in claim 35 wherein said resistance increases at an increasing rate as said player moves said engaging member away from said engaging member home position.

37. A football training system comprising:

a base;

a first support moveably mounted on said base;

a second support moveably mounted on said first support; and an engaging member support for supporting an engaging member above the ground;

said engaging member being adapted to move away from the ground along a path that cooperates with the ground to define a predetermined angle and said second support also being adapted to move on said first support;

wherein said football training system further comprises:

a resistance system coupled to at least one of said first support, said second support or said engaging member support for providing resistance as a player moves said engaging member away from an engaging member home position;

wherein said resistance increases at an increasing rate as said player moves said engaging member away from said engaging member home position;

wherein said second support comprises a weight support for supporting weight, said resistance system further comprising:

a drive chain coupling a first frame, a second frame and said weight support such that when said player moves said engaging member away from an engaging member home position said weight support moves to provide a generally increasing amount of resistance to the player.

38. The football training system as recited in claim 24 wherein said engaging member is mounted on said engaging member support such that it swivels about an axis.

39. The football training system as recited in claim 24 wherein said system comprises a height adjuster associated with said second support for adjusting a height of said engaging member relative to the ground.

40. The football training system as recited in claim 24 wherein said second support comprises a plurality of wheels defining a track, said engaging member support comprising a substantially linear support member for receipt in said track;

said linear support member comprising at least one support column on which said engaging member is pivotally mounted.

41. The football training system as recited in claim 24 wherein engaging member support comprises a plurality of height adjustment settings for adjusting a position of said engaging member to a plurality of different heights, respectively.

42. The football training system as recited in claim 24 wherein said engaging member is adapted to move in a direction that is not parallel to the ground in response to a player engaging said engaging member.

43. The football training system as recited in claim 24 wherein said engaging member is situated at a predetermined angle such when said engaging member is engaged, it moves generally upward along a path that diverges from the ground at a predetermined angle.

44. The football training system as recited in claim 24 wherein said engaging member is moveably mounted to said second support such that when said engaging member is engaged, it moves generally upward along a path that diverges from the ground at a predetermined angle.

45. The football training system as recited in claim 24 wherein said predetermined angle is at least 45 degrees.

46. The football training system as recited in claim 24 wherein said system comprises a first sensor associated with said engaging member for measuring a first impact and a second impact, said first impact generally occurring in response to a player engaging said engaging member and said second impact corresponding to when said engaging member reaches a second position.

47. The football training system as recited in claim 46 wherein said second position corresponds to when said engaging member stops moving relative to said second support.

48. The football training system as recited in claim 24 wherein said system comprises a second sensor for measuring at least one of a speed at which said engagement member moves or a distance said engagement member moves.

49. The football training system as recited in claim 46 wherein said system comprises a second sensor for measuring at least one of a speed at which said engaging member moves or a distance said engaging member moves.

50. The football training system as recited in claim 24 wherein said system comprises a second sensor for measuring both a speed at which said engaging member moves and a distance said engaging member moves.

51. A training system comprising:

a first frame;

a second frame moveably mounted on said first frame; and an engaging member moveably mounted on said second frame;

said second frame being adapted to move from a second frame home position in a first predetermined direction when a player engages said engaging member and said engaging member adapted to move from an engaging member home position in a second predetermined direction in response to said player engaging said engaging member;

wherein said first predetermined direction is different from said second predetermined direction, said first predetermined direction being forward and said second predetermined direction being upward at an acute angle relative to the ground;

wherein said training system comprises resistance means for providing at least one of a variable or fixed resistance to said player after said player engages said engaging member and moves it in at least one of said first or second predetermined directions.

52. A training system comprising:

a first frame;

a second frame moveably mounted on said first frame; and an engaging member moveably mounted on said second frame;

said second frame being adapted to move from a second frame home position in a first predetermined direction when a player engages said engaging member and said engaging member adapted to move from an engaging member home position in a second predetermined direction in response to said player engaging said engaging member;

wherein said first predetermined direction is different from said second predetermined direction;

wherein said training system comprises resistance means for providing at least one of a variable or fixed resistance to said player after said player engages said engaging member and moves it in at least one of said first or second predetermined directions;

wherein said resistance means comprises a weight support for supporting weight, said training system further comprising:

a drive coupling said first frame, said second frame and said weight support such that when said player moves said engaging member away from said engaging member home position, said weight moving on a second member to provide an increased amount of resistance to said player.

53. The training system as recited in claim 52, wherein said drive is a drive chain.

* * * * *